US007069935B2

(12) United States Patent
Bousfield et al.

(10) Patent No.: US 7,069,935 B2
(45) Date of Patent: Jul. 4, 2006

(54) HAIR BRAIDER

(75) Inventors: Patrick Bousfield, Middlesex (GB); Ole Boysen, London (GB)

(73) Assignee: Elysee Beauty Products, Ltd., Hong Kong (CN)

( * ) Notice: Subject to any disclaimer, the term of this patent is extended or adjusted under 35 U.S.C. 154(b) by 334 days.

(21) Appl. No.: 10/760,114

(22) Filed: Jan. 16, 2004

(65) Prior Publication Data

US 2005/0039769 A1 Feb. 24, 2005

Related U.S. Application Data

(60) Provisional application No. 60/440,993, filed on Jan. 17, 2003.

(51) Int. Cl.
*A45D 7/00* (2006.01)
*A45D 7/02* (2006.01)

(52) U.S. Cl. ..... 132/210; 132/212

(58) Field of Classification Search ..... 132/210, 132/212, 148; 87/8, 13, 33, 62, 25; 446/472, 446/259, 442
See application file for complete search history.

(56) References Cited

U.S. PATENT DOCUMENTS

| | | | | |
|---|---|---|---|---|
| 4,038,996 | A * | 8/1977 | Eronini et al. | 132/271 |
| 4,222,398 | A | 9/1980 | Fromman | |
| 4,369,690 | A | 1/1983 | Sapkus | |
| 4,427,017 | A * | 1/1984 | Eronini | 132/271 |
| 5,671,759 | A | 9/1997 | Chung et al. | |
| 5,988,181 | A * | 11/1999 | Gable et al. | 132/210 |
| 6,318,378 | B1 | 11/2001 | Kennedy et al. | |
| 6,520,187 | B1 * | 2/2003 | Lee et al. | 132/212 |
| 6,575,175 | B1 * | 6/2003 | Kim et al. | 132/210 |
| 6,615,846 | B1 | 9/2003 | Leason et al. | |
| 6,662,808 | B1 | 12/2003 | Leason et al. | |
| 2003/0075198 | A1 | 4/2003 | Kim et al. | |

FOREIGN PATENT DOCUMENTS

| | | | |
|---|---|---|---|
| DE | 199 14 878 | A1 | 10/2000 |
| WO | WO-01/54535 | A1 | 8/2001 |
| WO | WO 03/007751 | A1 * | 1/2003 |

* cited by examiner

*Primary Examiner*—Kevin Shaver
*Assistant Examiner*—Stephanie Willatt
(74) *Attorney, Agent, or Firm*—Darby & Darby

(57) ABSTRACT

A hair braider includes a body having a handle and a head portion. A selectively rotatable drive source is disposed within the body. First and second overlapping, rotatable rotors are disposed within the head portion and are operatively coupled to the drive source through a plurality of gears such that the first and second rotors rotate in opposite directions when the drive source is actuated. The hair braider includes a plurality of hair retaining members that are received within openings formed through the first and second rotatable rotors. Each hair retaining member has a bore formed within it for receiving a bundle of hair. A mechanism transfers one hair retaining member from one rotor to the other rotor as the rotors rotate. The rotation of the rotors and the successive transfer of one hair retaining member from one rotor to the other rotor results in a braid being formed.

39 Claims, 8 Drawing Sheets

HAIR BRAIDER

CROSS-REFERENCE TO RELATED APPLICATION

This application claims the benefit of U.S. patent application Ser. No. 60/440,993, filed Jan. 17, 2003, which is hereby incorporated by reference in its entirety.

TECHNICAL FIELD

The present invention relates generally to a device for manipulating hair, and more particularly, to a device configured to plait or braid strands of hair in response to a motor drive.

BACKGROUND

Devices that utilize motor drives to manipulate hair are known, and include hair styling devices as described in U.S. Pat. No. 6,318,378 of Kennedy et al. The Kennedy et al. device performs sequential operations of twisting two bundles of hair at once, followed by cabling of the twisted strands. Hair bundles are engaged by rotatable clamps that are, in turn, mounted on a rotatable platform. There are also commercially available devices modeled after the Kennedy et al. arrangement that have clamps and platform supported on interchangeable heads, with each head supporting a different number of clamps (e.g., three or four). Conair of Greenwich, Conn. markets one such device under the name Quick Braid™ Styling Kit with Ribbon Braider. As well, there are devices known in the art for wrapping hair with cord as described in U.S. Pat. No. 5,671,759 of Chung et al. and in commonly assigned U.S. Pat. Nos. 6,615,846 and 6,662,808 of Leason et al.

While these devices permit hair to be manipulated or adorned, they are special purpose devices suitable for only one task. What would be of benefit in the art is a simple yet effective hair braider that permits true plaiting or braiding of hair, that is, weaving of three bundles of hair with and among each other into a plait or braid. The present invention addresses these and other needs.

SUMMARY

A hair braider is provided and is configured to perform a three-bundle plait or braid and includes a body having a handle and a head portion at one end of the handle; a selectively actuatable drive source disposed within the body; and first and second rotatable rotors that are disposed within the head portion and are accessible through openings formed in the head portion. The first and second rotatable rotors are operatively coupled to the drive source through a plurality of gears such that the first and second rotors rotate in opposite directions when the drive source is actuated.

The hair braider further includes a plurality of hair retaining members that are received within openings formed through the first and second rotatable rotors, wherein each hair retaining member has a bore formed therethrough for receiving one bundle of hair. In addition, a mechanism for transferring at a transfer location one hair retaining member from one rotor to the other rotor as the rotors rotate, wherein the initial arrangement of the hair retaining members within the openings. The rotation of the rotors in opposite directions and the successive transfer of one hair retaining member from one rotor to the other rotor results in a true, three-bundle braid being formed.

In addition, a method of braiding hair in a three-bundle plait or braid is provided and includes the steps of: (1) providing a hair braider that includes: (a) a plurality of first and second rotors that rotate in opposite directions under the action of a drive mechanism; (b) a plurality of hair retaining members that are received within openings formed in the first and second rotors and act to carry one bundle of hair, wherein the first and second rotors at least partially overlap such that in a transfer location, one opening of one rotor overlaps one opening in the other rotor, and (c) a mechanism for automatically transferring one hair retaining members from one rotor to the other rotor whenever the one hair retaining member is disposed in the transfer location; (2) disposing a first bundle of hair in a hair retaining member and through one opening in the first rotor; a second bundle of hair in another hair retaining member and through another opening in the first rotor and a third bundle of hair in another hair retaining member and through one opening in the second rotor such that in a left-to-right order of the hair bundles there is a left hair bundle, a central hair bundle and a right hair bundle, wherein in the initial position, the first hair bundle is the left hair bundle, the second hair bundle is the central hair bundle and the third hair bundle is the right hair bundle, wherein the central hair bundle is always disposed in the transfer location; and (3) rotating the first and second rotors in opposite directions with the three hair bundles being carried in respective circular orbits such that a number of successive hair bundle swaps are preformed as a result of the rotation of the rotors and action of the mechanism with the swaps being defined by successive swaps of the central hair bundle and one of the left and right hair bundles and then the central hair bundle with the other of the left and right hair bundles, thereby resulting in a three-bundle braid being formed.

Further aspects and features of the exemplary apparatus disclosed herein can be appreciated from the appended Figures and accompanying written description.

BRIEF DESCRIPTION OF THE DRAWING FIGURES

The invention will be more fully understood by reference to the following drawings which are for illustrative purposes only:

Figure 11A:
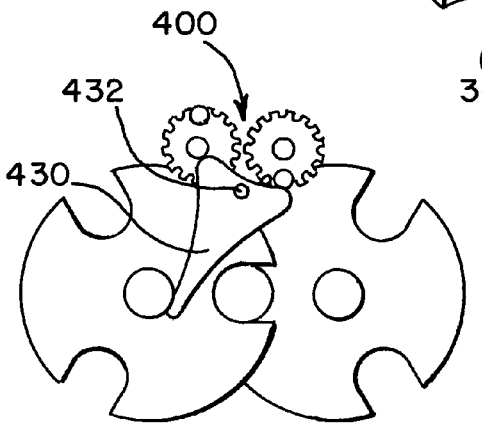
Figure 11B:
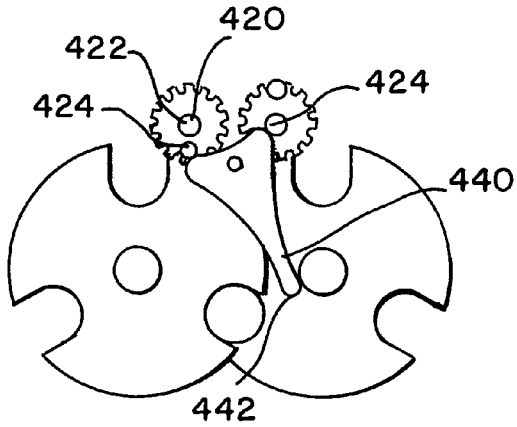
Figure 12A:
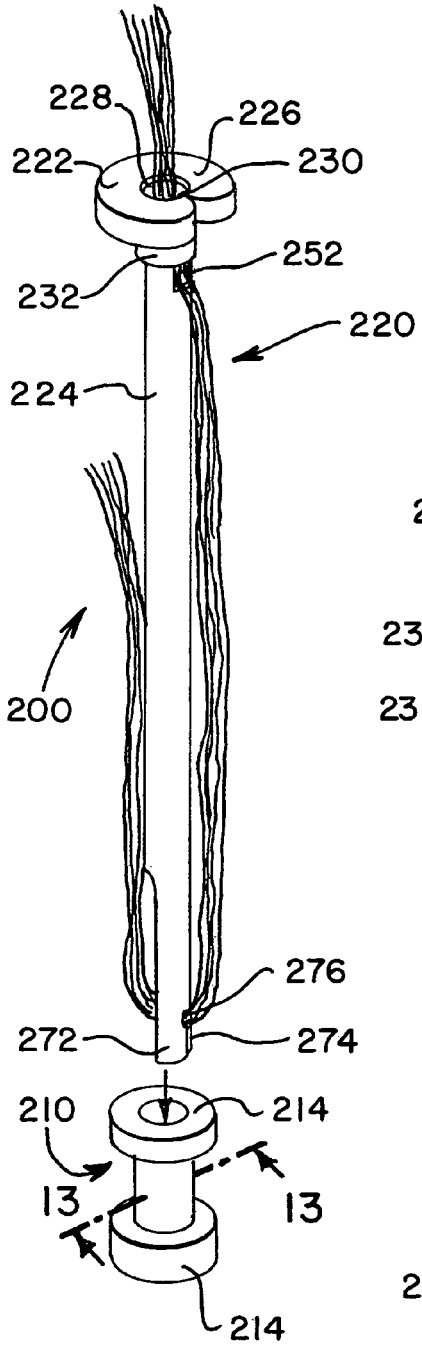
Figure 13:
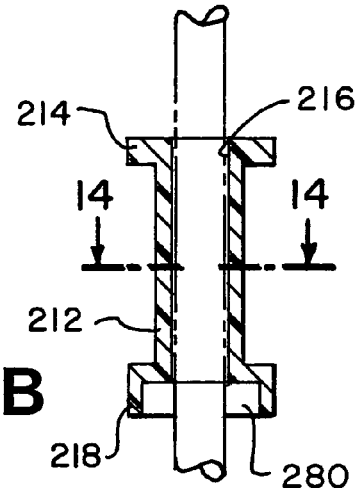
Figure 12B:
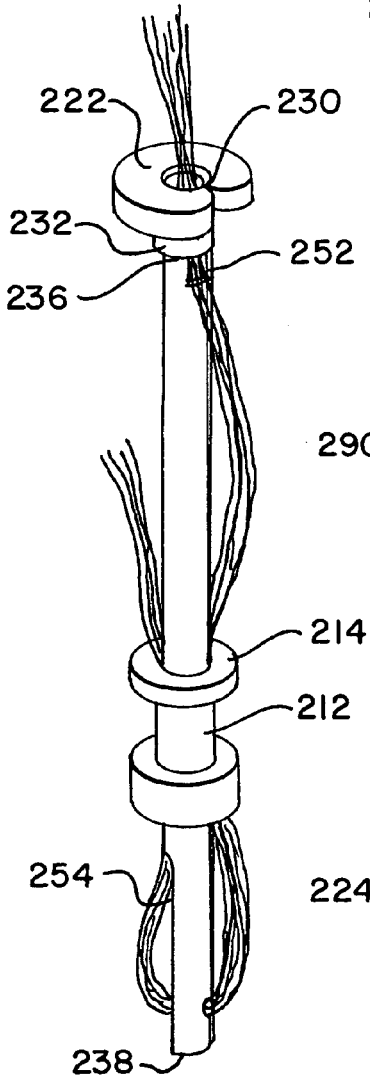
Figure 14A:
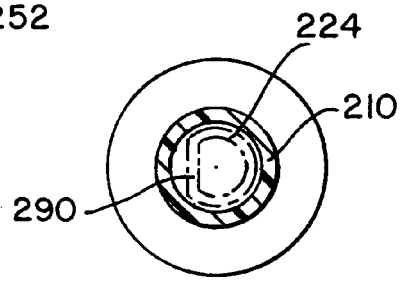
Figure 14B:
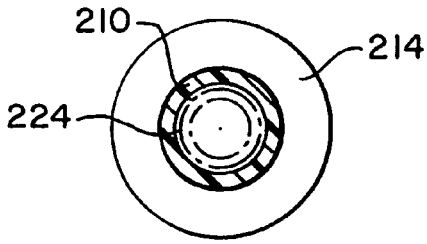
Figure 15:
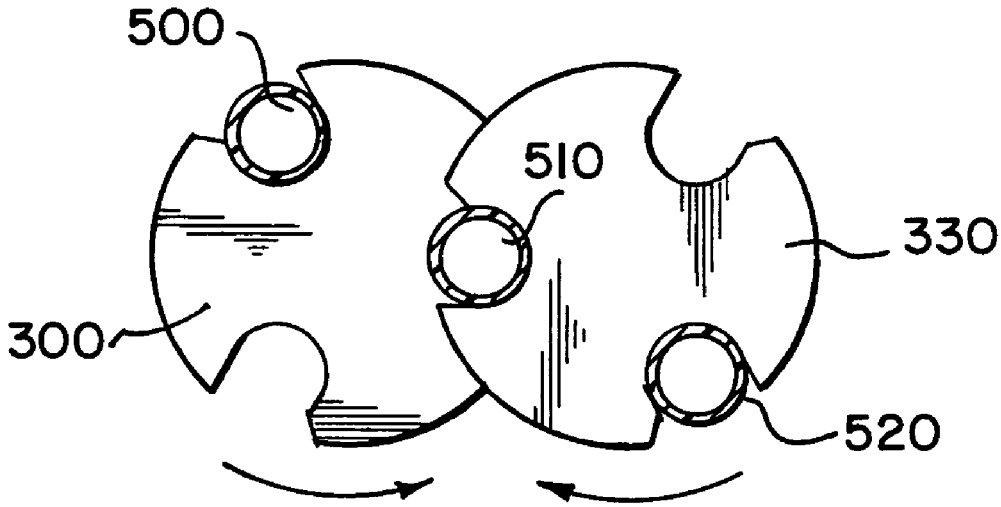

FIGS. 10(*a*) through (*h*) illustrate eight sequential views of the gear wheels when driven so as to plait hair;

FIG. 11A is a top plan view of the gear wheels with an urging element being shown in a first position;

FIG. 11B is a top plan view of the gear wheels with the urging element being shown in a second position;

FIG. 12A is a perspective view of a hair threader with hair secured thereto exploded from a corresponding hair retaining member the receives the hair threader;

FIG. 12B is a perspective view of the hair threader being at least partially inserted into the hair retaining member;

FIG. 13 is a cross-sectional view of the hair threader received within the hair retaining member;

FIG. 14A is a cross-sectional view taken along the line 14—14 illustrating an elongated threader tube member according to one embodiment;

FIG. 14B is a cross-sectional view taken along the line 14—14 illustrating an elongated threader tube member according to another embodiment; and FIG. 15 is a top plan view of gear wheels according to another embodiment and the urging element.

DETAILED DESCRIPTION OF PREFERRED EMBODIMENTS

Referring first to FIGS. 1–5, FIG. 1 is a top and side perspective view of a hair braider 100 according to one exemplary embodiment. The hair braider 100 includes a head 110 and a handle 120 that is disposed at a predetermined angle relative to the head 110. The handle 120 is constructed so that it houses a number of the working components of the hair braider 100 and more specifically, the handle 120 houses a power source 130, such as one or more batteries (e.g., 2 AA size batteries) along with a motor 140 that is operatively connected to the power source 130 as well as a main gear box 150 that serves to drive other working components of the hair braider 100 as described in greater detail below. The handle 120 can assume any number of different contours that are ergonomically pleasing to a user's hand and permit the hair braider 100 to be easily grasped and held by the user as the braiding operation is performed.

In the illustrated embodiment, the handle 120 has a slight curvature to it and has a first end 122 that mates with and is integral to the head 110 and an opposing second end 124. Typically, the power source 130 is located at or near the second end 124 and the main gear box 150 is located at or near the first end 122 with the motor 140 being disposed between the main gear box 150 and the power source 130. According to one exemplary embodiment, the angle between the handle 120 and the head 110 is about 45 degrees; however, this is merely exemplary and the angle between these two parts can either be less than or greater than 45 degrees.

A switch mechanism 170 is also provided in the handle 120 to selectively activate the motor 140 and cause the braiding operation to either commence or terminate. The switch mechanism 170 is formed on an upper face 112 of the handle 120 and is operatively connected to the motor 140 and the main gear box 150. Any number of types of switch mechanisms 170 can be used to selectively activate the motor 140. For example, one type of switch mechanism 170 is a push button type on/off switch, while another type of switch mechanism is a slideable on/off type button. It will be appreciated that any other type of switch mechanism, e.g., a rotating switch member, can be used in the hair braider 100 of the present invention. The actual switch component, e.g., button 172, can be surrounded by a skirt 174 or the like that further sets off the switch mechanism 170 from the surrounding handle 120. The switch mechanism 170 can optionally control the speed of the motor 140.

In one embodiment, the motor 140 can be of a single speed, single direction in that activation thereof causes the motor to rotate at a predetermined speed in one direction. For example, one suitable speed at which the motor 140 rotates is about 40 rpm. However, it will be appreciated that the motor 140 can be of the type that is configured to operate at a number of different speeds and it will further be appreciated that the motor 140 can be permitted to rotate clockwise or counterclockwise. The motor drive can be as described in the aforementioned Kennedy et al. patent or it may be any other type of motor drive that is suited for the intended purpose.

The power source 130 is in the form of one or more batteries that can be accessed along a lower face 114 of the handle 120 to permit easy installation and replacement of the batteries. For example, a removable battery lid 116 can be provided to cover a battery compartment 117 where the batteries 130 are disposed. The battery lid 116 is of a conventional design that is constructed to permit the user to easily remove and replace the lid 116 with little effort. For example, the battery lid 116 can be of a snap fit design.

The head 110 of the hair braider 100 has a generally oval, oblong or annular shape and is defined by an upper face 113 and an opposing lower face 115 and an arcuate vertical wall 119 that extends between the upper face 113 and the lower face 115. Each of the upper face 113 and the lower face 115 has a cut out 126 formed therein and preferably, the cut outs 126 in the upper and lower faces 113, 115 have substantially the same or are identical in terms of their shapes. In any event, the cut outs 126 have to be complementary to one another and of sufficient size to permit hair to be passed through the hair braider 100 from one of the faces 113, 115 to the other of the faces 113, 115. In one embodiment, as illustrated, the cut out 126 is in the form of two circles that are partially overlapped with another along a perimeter edge thereof. Thus, the wall of the upper face 113 that defines the cut out 126 has the general outline of an "8". Preferably, the upper face 113 and the lower face 115 include the same shaped cut out 126 with the cut out 126 in the upper face 113 perfectly overlying the cut out 126 in the lower face 115.

The main gear box 150 includes a drive shaft 152 that is driven by the motor 140 and is configured so that it operatively mates with working gears that are disposed within the head 110 as is described in detail below. At one end of the drive shaft 152, a toothed drive gear 154 is provided and is orientated so that its teeth intermesh with teeth of at least one other gear for imparting rotation to these gears. As shown in the Figures, the drive gear 154 is at an angle relative to the rest of the working gears since the drive shaft 152 itself is at an angle due to it extending along the handle 120 as opposed to being located in the head 110.

Figure 2:
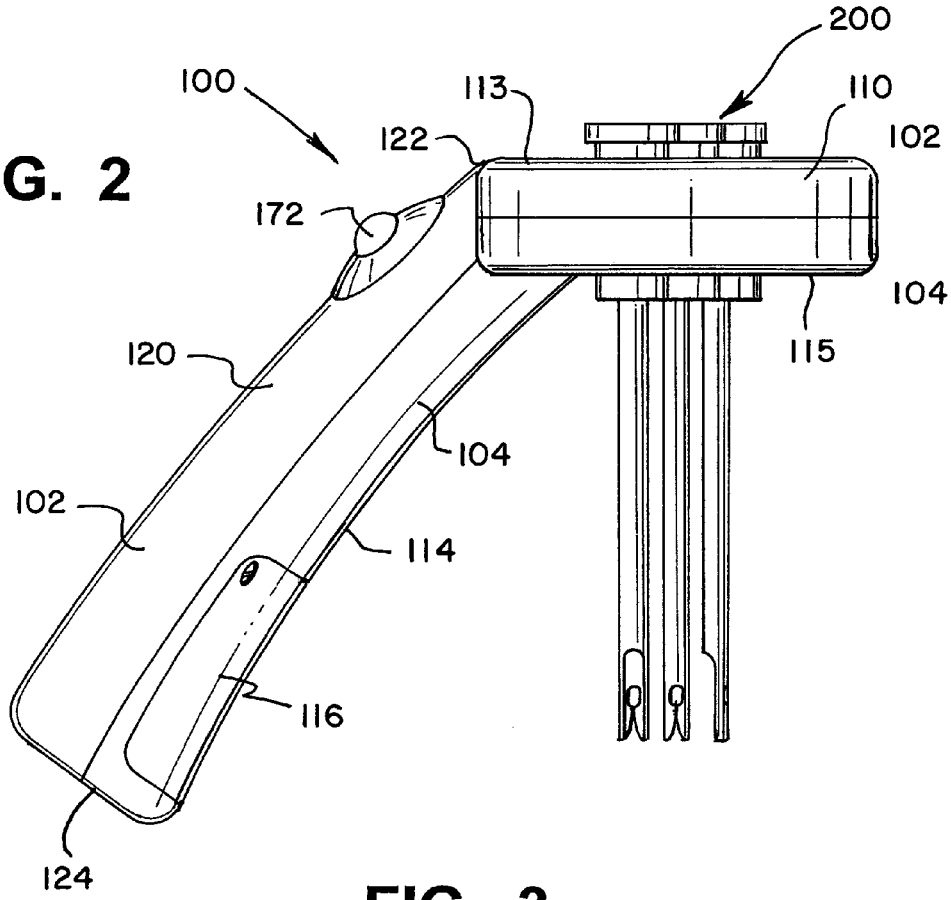
FIG. 2 is a side elevation view of the hair braider of FIG. 1.
Figure 3:
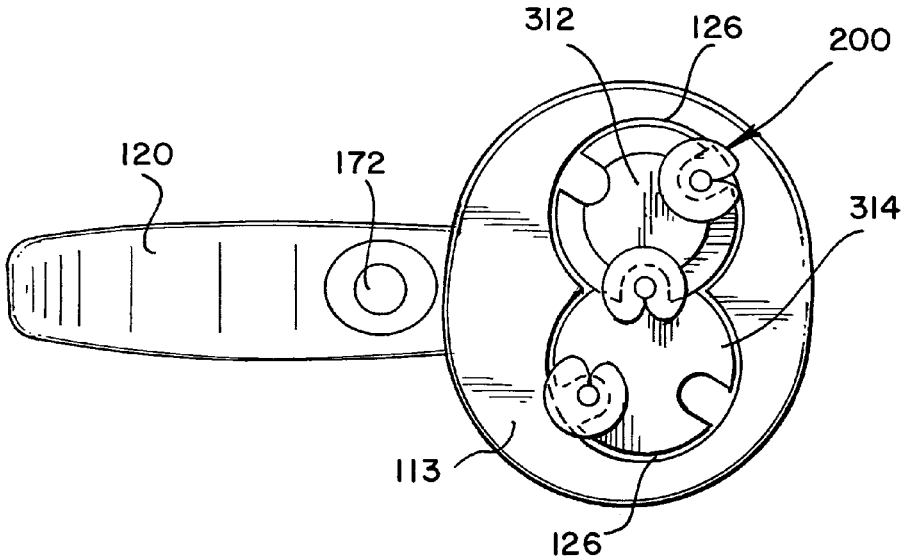
FIG. 3 is a top plan view of the hair braider of FIG. 1.
Figure 4:
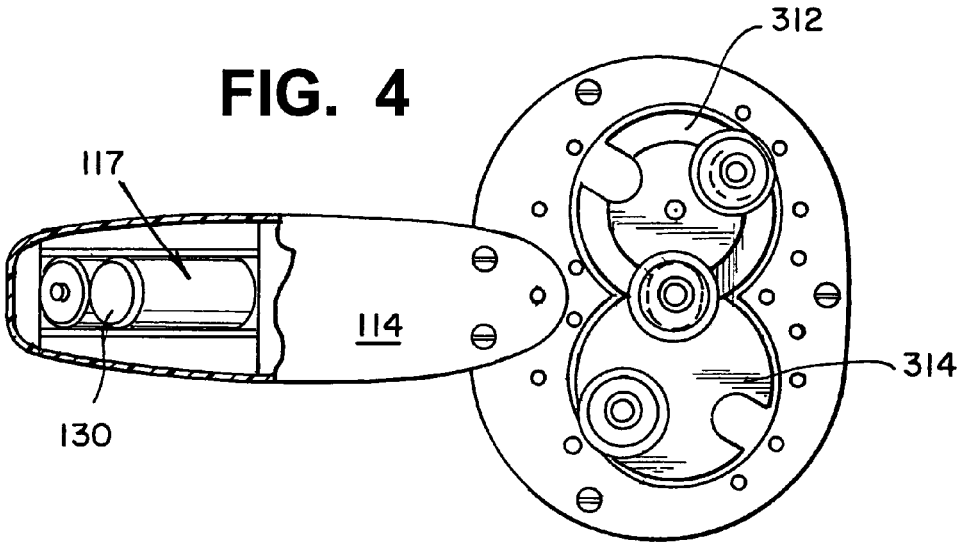
FIG. 4 is a bottom plan view of the hair braider of FIG. 1.
Figure 5:
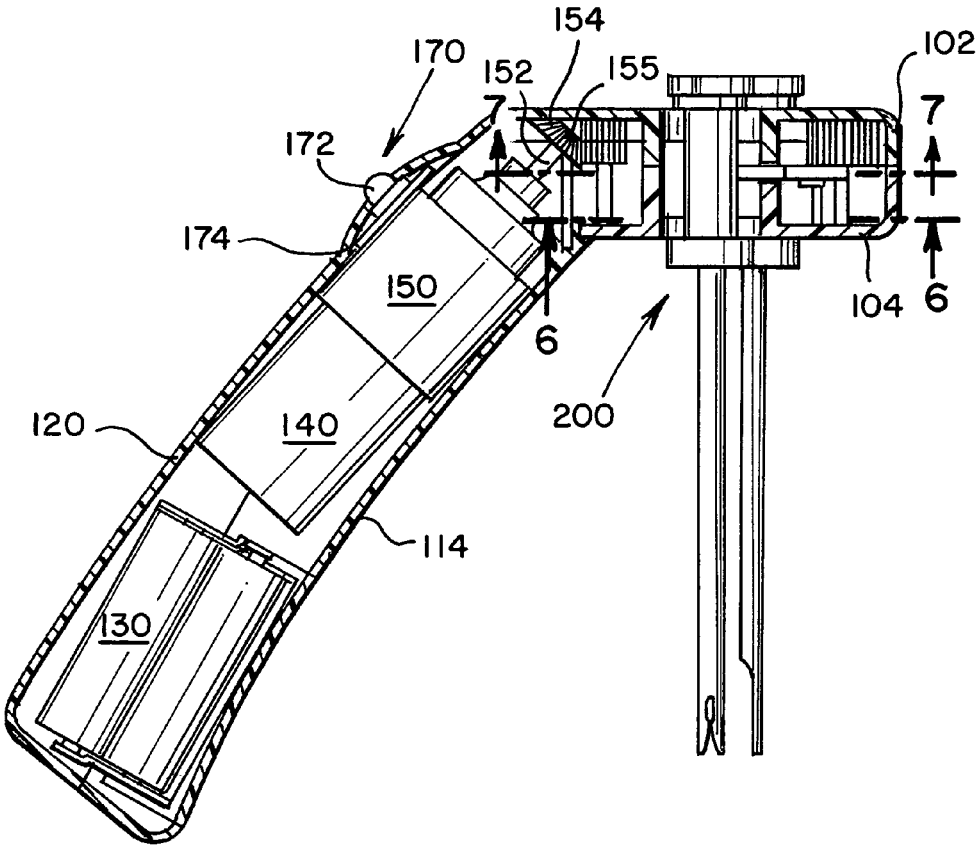
FIG. 5 is a cross-sectional side elevation view taken along the line 5—5 of FIG. 3.
Figure 6:
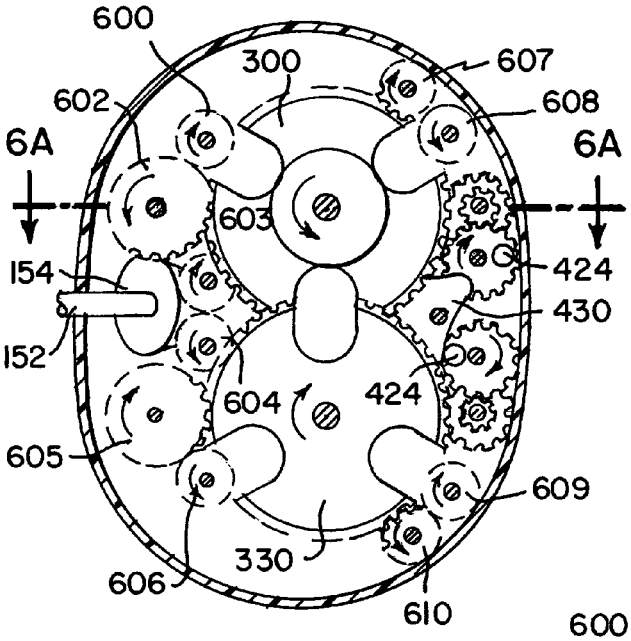
FIG. 6 is a cross-sectional view taken along the line 6—6 of FIG. 5.
Figure 7:
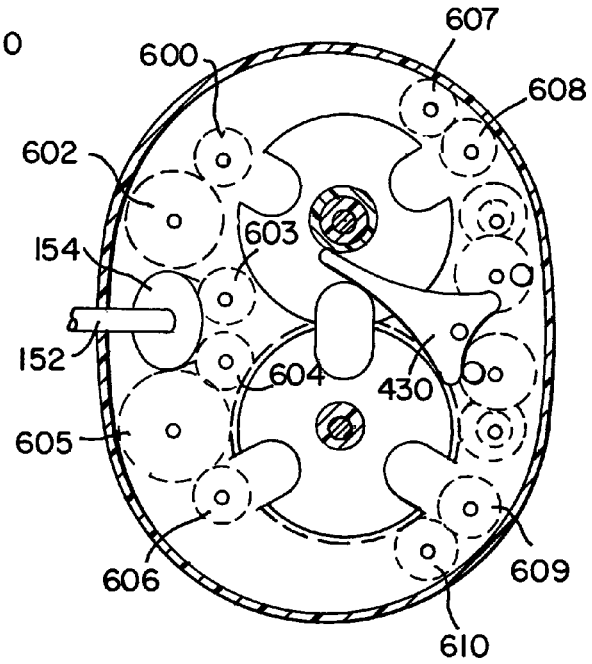
FIG. 7 is a cross-sectional view taken along the line 7—7 of FIG. 5.
Figure 6A:
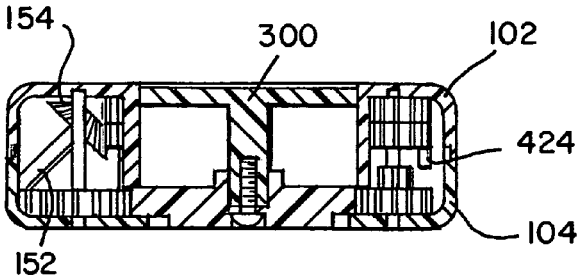
FIG. 6A is a cross-sectional view taken along the line 6A—6A of FIG. 6.

As shown in FIG. 2, in one embodiment, the hair braider 100 is formed of two molded parts that are generally split down the middle so as to define an upper molded part 102 and a lower molded part 104. This construction permits the working components to be easily disposed in one of the upper and lower molded parts 102, 104. It will be appreciated that this type of construction also provides ease of manufacturing since the split part design is of a simple nature compared to more complex designs. The two molded housing parts can be coupled together using any number of conventional techniques, including using snap fit means or the use of fasteners (screws). Optionally, a thin plastic film or a covering or the like can be disposed on an underside of the lower face 115 of the head 110 to hide fasteners and other undesirable markings that are present thereat. For example, a thin sheet of plastic can be glued on the lower face 115 to hide the fasteners, pins, etc. that are otherwise visible.

Referring now to FIGS. 1–15, the hair braider 100 includes a plurality of hair receiving members 200 that is each sized to receive a respective bundle of hair from a person or doll. The members 200 are journaled around and around in a prescribed pattern, as described herein, in order to plait hair. In one exemplary embodiment, each member 200 is formed of a number of parts that are operatively coupled to one another and more specifically, each member 200 includes a post 210 (i.e., cylindrical post) and a threader 220, both of which are preferably formed of a plastic material. The post 210 is a generally cylindrical member that is formed of a hollow cylindrical base 212 and a pair of flanges 214 that are disposed at each end of the cylindrical base 212. A bore 216 is formed through the cylindrical base 212 and is open at each end to permit hair to be received therethrough. The flanges 214 at each end of the cylindrical base 212 are preferably the same and are in the form of annular shaped discs that extend outwardly from the cylindrical base 212. Preferably, the flanges 214 are formed at right angles with respect to the cylindrical base 212 so as to form a pair of 90 degree shoulders. The lowermost flange 214 has one added feature relative to the uppermost flange 214 in that the lowermost flange 214 further includes an annular lip 218 that is formed on an underside of the lowermost flange 214 and around a peripheral edge thereof.

The threader 220 of the member 200 is designed to cooperate with and more specifically be securely coupled to the cylindrical post 210. The threader 220 itself is formed of several parts that are coupled to one another in that the threader 220 includes a threader head 222 and an elongated tube member 224 that extends from the threader head 222 when the two are coupled to one another. The threader head 222 includes a generally disc-shaped body 226 that has a central opening 228 formed therein. The head 222 is actually of a split design (like a split washer) in that a small channel 230 is formed therein and defines and separates two sections of the threader head 222. The channel 230 forms an entrance to the central opening 228. Preferably, the two body sections of the head 222 that define the channel 230 are tapered or rounded so that an entrance into the channel 230 has a greater width than the width of the channel 230. By rounding off the edges of these two sections and increasing the width of the entrance to the channel 230, the strand of hair can more easily be received and guided into the channel 230. A cylindrical boss 232 is integral to the disc shaped body 226 and extends outwardly away from one face thereof (preferably at a right angle relative to the disc shaped body). The cylindrical boss 232 has a bore 234 formed therethrough which is axially aligned with the central opening 228 to permit hair to pass therethrough. The boss 232 also has a channel formed therethrough which aligns with the channel 230 to permit the strand or bundle of hair to be received through both channels and into the opening 228, bore 234.

The elongated tube member 224 has a first end 236 and an opposing second end 238 with the first end 236 being configured to securely mate with the cylindrical boss 232. More specifically, the elongated tube member 224 is a generally cylindrically shaped tube member that is sized so that the first end 236 thereof can be received within the bore 234 formed through the cylindrical boss 232. The inner diameter of the cylindrical boss 232 is greater than the inner diameter of the central opening 228 resulting in a stop being formed therebetween. The stop serves to limit the degree of travel of the elongated tube member 224 within the cylindrical boss 232. In other words, when the first end 236 is placed within the bore 234, the elongated tube member 224 is moved within the cylindrical boss 232 until the first end 236 seats against the stop. The elongated tube member 224 is coupled to the threader head 222 using any number of techniques, including establishing a frictional fit between the two parts and more preferably, a small amount of adhesive can be disposed around the outer surface of the first end of the member 224. This adhesive acts to bind the elongated tube member 224 to the cylindrical boss 232 and therefore, the elongated tube member 224 is securely attached and positioned relative to the threader head 222.

The elongated tube member 224 has several cut outs formed therein and more specifically, the illustrated tube member 224 has a first cut out 252 formed at the first end 236 and a second cut out 254 formed at the second end 238. The first cut out 252 represents a generally square or rectangular shaped window that is formed in the elongated tube member 224. The height of the first cut out 252 is greater than the length or height of the cylindrical boss 232 of the threader head 222 so that when the elongated tube member 224 is disposed within the cylindrical boss 232, a bottommost section of the window extends below the cylindrical boss 232, thereby permitting the user to visually see the interior (within the bore) of the elongated tube member 224 where the hair is present. When the threader head 222 is secured to the elongated tube member 224, the channel 230 formed in the disc-shaped member is aligned with the first cut out 252 so that a strand of hair can be inserted into the channel 230 into the central opening 228 and then fed back out through the first cut out 252 as described in greater detail hereinafter.

As with the first cut out 252, the second cut out 254 represents a section of the cylindrical wall of the tube member 224 that has been removed from the elongated tube member 224. The innermost section of the second cut out 254 is defined by curved wall segments 260. In the illustrated embodiment, both the first and second cut outs 252, 254 do not extend more than 180 degrees around the elongated tube member 224, thereby leaving at least about 180 degrees of cylindrical wall remaining. Further, in the illustrated embodiment, the first cut out 252 and second cut out 254 are formed on opposing sides of the cylindrical wall of the tube member 224 and therefore face opposite directions. At the second end 238 of the elongated tube member 224, a hair retaining feature 270 is formed thereat for selectively holding and orientating a strand of hair relative to the hair braider 100. One exemplary hair retaining feature 270 is a split end formed by a pair of fingers 272 with a groove or space 274 formed therebetween to permit and accommodate flexing of the fingers 272 as a strand of hair is inserted within the space 274. The groove 274 extends from the second end and opens into an opening 276 formed in the tube member 224 for receiving and carrying the strand of hair. The opening 276 is thus sized so that the strand of hair can comfortably be received within and carried within the opening. The opening 276 can have any number of shapes with some exemplary shapes being a circle, an oval, oblong and ellipsoidal, etc.

Distal ends of the fingers 272 are outwardly tapered so that the groove 274 is greatest at its distal end as opposed to the proximal end where the groove 274 is in communication with the opening 276. This configuration acts as a funnel arrangement and makes it easier to receive the strand of hair since the strand is received in the widest section of the groove 274 and then once captured, the strand can be advanced along the groove 274 until the strand enters and is captured in the opening 276. Since the strands of hair can be of different sizes, the formation of flexible fingers 272 permits the variably sized strands of hair to be received and advanced within the groove 274 to the opening 276.

The cylindrical post 210 also includes a ring-shaped member 280 that is disposed adjacent a bottom face of the lowermost flange 214. The ring-shaped member 280 is formed of an elastic, flexible material, such as a soft rubber, and the thickness of the ring-shaped member 280 is such that the ring-shaped member 280 is disposed between the annular lip 218. The annular lip 218 preferably includes undercuts to retain the ring-shaped member 280. Preferably, the ring-shaped member 280 does not extend below the annular lip 218. The opening formed in the ring-shaped member 280 has a diameter that is greater than an outer diameter of the elongated tube member 224 so that a small space (annular shaped) is formed therebetween. The diameter of the opening of the ring-shaped member 280 is less than the diameter of the inner diameter of the bore formed through the cylindrical post 210.

To assemble and locate and retain a strand of hair within the hair retaining member, a strand of hair is inserted into the channel 230 formed in the disc-shaped member and then into the central opening 228. The strand of hair is not fed through the bore of the elongated tube member 224 along the length thereof but rather the strand of hair is fed down along the outer surface (exterior) of the elongated tube member 224. The strand of hair is then fed between the pair of flexible fingers 272 into the groove 274 and ultimately into the opening 276. After the strand of hair is fed through the opening 276, the strand of hair is then fed up along the opposite side of the outer surface of the elongated tube member 224. The strand of hair extends up along the elongated tube member 224 such that a tip end of the strand of hair is located below the threader head 222.

The second end 238 of the elongated tube member 224 is inserted into the cylindrical post 210 with the second end 238 of the tube member 224 extending below the lowermost flange 214. When the elongated tube member 224 is fed through the bore 216 of the cylindrical post 210, the strand of hair is disposed between the outer surface of the elongated tube member 224 and the inner surface of the bore 216. The strand of hair, including the distal tip, is fed up so that it extends above the uppermost flange 214 of the cylindrical post 210. The elongated tube member 224 is continuously lowered into the bore until an underside of the disc-shaped member of the threader head 222 contacts and seats against the uppermost flange 214 of the cylindrical post 210. The threader 220 is constructed and is intended to make it easier to pull (thread) the hair through the cylindrical post 210 as part of the operation of the hair braider 100.

In yet another embodiment, the elongated tube member 224 is not completely cylindrical in shape but rather a longitudinal flat 290 is formed along one side of the elongated tube member 224 as shown in FIG. 14A. The longitudinal flat 290 extends from one end of the elongated tube member 224 to the other end. When the strand of hair is fed up along the outer surface of the elongated tube member 224 after being received through the central opening, the strand of hair is fed up along the longitudinal flat 290. This longitudinal flat 290 provides room for the thread of hair to be threaded through the cylindrical post 210.

Figure 9:
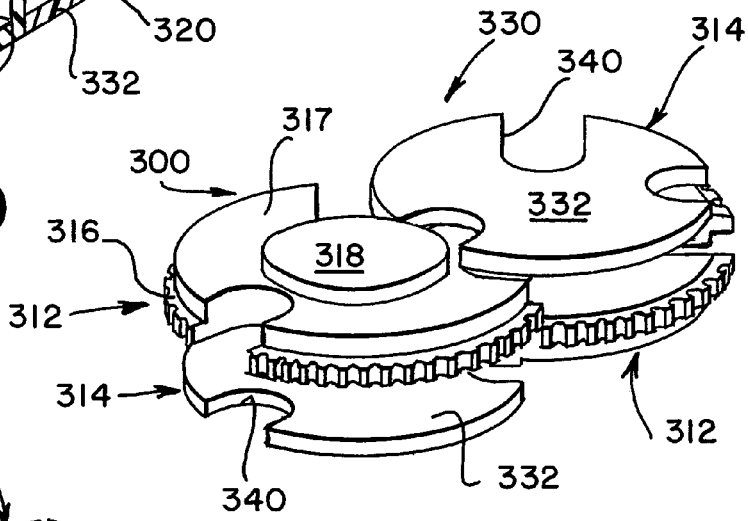
FIG. 9 is a perspective of two gear wheels meshing with one another.

As best shown in FIG. 9, the means for locating and journaling the cylindrical posts 210 around and around according to the prescribed pattern is a pair of cooperating first and second gear wheels 300, 330 (also called rotors) that are housed within the head 110 of the hair braider 100. The first gear wheel 300 and the second gear wheel 330 are similar but there are differences between the two as will be described hereinafter. For ease of illustration, the first gear wheel 300 can be thought of as a left gear wheel and the second gear wheel 330 can be thought of as a right gear wheel when viewed from the top of the braider 100. Each of the first and second gear wheels 300, 330 is formed of a pair of parts that cooperate and are operatively coupled to one another to form the respective gear wheel 300, 330. The specific construction of the pair of parts is variable and there are a number of different embodiments that are suitable constructions for the first and second gear wheels 300, 330; however, the function and operation of the gear wheels 300, 330 remain the same in each of the embodiments.

One exemplary first gear wheel 300 is formed of a first (upper) part 312 and a second (lower) part 314 that are securely yet preferably releasably secured to one another. The first part 312 is formed of a body that includes three concentric disc-shaped portions 316, 317, 318 of varying diameter. More specifically, the first disc-shaped member 316 has the greatest diameter and is the lowermost of the three disc-shaped portions, while the second disc-shaped member 317 has a diameter that is less than the first disc-shaped member 316 but greater than the third disc-shaped member 318. The third disc-shaped member 318 is in the form of a circular disc that sits on top of a center section of the second disc-shaped member 317. It will be appreciated that right angle shoulders are formed between each of the adjacent disc-shaped members.

The second part 314 mates with the first part 312 to form the gear wheel and is formed of a disc-shaped member 332 that is configured to mate with and securely attach to the first disc-shaped member 316 and more specifically, one face of the first disc-shaped member 316 includes a feature that is complementary to and mates with a complementary feature for securely coupling the two parts 312, 314 to one another.

The first disc-shaped member 316 includes a center boss 320 that extends outwardly from a center section of one face thereof and is constructed to mate with a complementary feature formed on one face of the second part 314. For example, one face of the disc-shaped member 332 can include a boss 334 that is sized to mate with the boss 320 such that the first and second parts 312, 314 are securely attached to one another. The boss 334 of the second part 314 acts as a spacer or central hub for the first gear wheel 300 since it serves to space the two parts 312, 314 a predetermined distance from another to permit another member to gain access and be disposed between the first and second parts 312, 314 as is described below.

The first gear wheel 300 includes a plurality of peripheral cut outs or notches 340 formed therein and extending radially therearound. In the illustrated embodiment, there are three notches formed as part of the first gear wheel 300. The notches 340 are configured and sized to receive the cylindrical posts 210 as will be described hereinafter. In the illustrated embodiment, the notches 340 are formed in the first and second disc-shaped members 316, 317 and not in the third disc-shaped member 318. The notches 340 are formed at and along the perimeter edge of the disc-shaped member 316 and extend inwardly therefrom with the notch opening being accessible along the perimeter edge of the first gear wheel 300. The innermost edges of the notches in the first and second disc-shaped members 316, 317 are aligned so that the inner edge of the notch is a smooth edge. The notches 340 formed in the second disc-shaped member 317 extend close to but are not formed in the third disc-shaped member 318 but rather are formed radially therearound. The disc-shaped member 332 of the second part 314 includes a plurality of notches 340 that align with the notches 340 formed in the first part 312 when the first and second parts 312, 314 are coupled to one another.

The second gear wheel 330 is similar to or identical to the first gear wheel 300 and is formed of two parts 312, 314 that cooperate and mate with one another. In the illustrated embodiment, the first and second gear wheels 300, 330 are identical and are merely orientated in opposite directions in the head 110. More specifically, the second gear wheel 330 includes the first part 312 and the second part 314 that are coupled to one another. However, the second gear wheel 330 is orientated in the head 110 in the opposite direction such that the second part 314 is the upper part that is adjacent the first part 312 of the first gear wheel 300 and the first part 312 is the lower part adjacent the second part 314 of the first gear wheel 300. Thus, the third disc-shaped member 318 faces upward in the first gear wheel 300, while the third disc-shaped member 318 faces downward in the second gear wheel 330 and therefore, when the two gear wheels 300, 330 are disposed in the same plane, the third disc-shaped member 318 of the first gear wheel 300 is aligned with and lies in the same plane as the disc-shaped member 332 of the second part 314. Similarly, the third disc-shaped member 318 of the second gear wheel 330 is aligned with and lies in the same plane as the disc-shaped member 332 of the second gear wheel 330.

In the illustrated embodiment, the first and second gear wheels 300, 330 each includes three notches. It will also be understood that the notches 340 formed in the first and second gear wheels 300, 330 are complementary to one another and preferably are identical since the notches 340 are designed to receive the members that carry the threads of hair during the plating (braiding) operation and permit transfer of these members from one gear wheel to the other gear wheel.

It will be appreciated that at each face of the first and second gear wheels 300, 330, the third disc-shaped member 318 keeps the hair retaining features (cylindrical posts, etc.) at the same height along each face of the first and second gears 300, 330 since the gear wheels 300, 330 at least partially intermesh with one another in an overlapping manner. More specifically, the first and second disc-shaped members 316, 317 of each wheel 300, 330 are disposed between the disc-shaped member 332 of the second part 314 and the first disc-shaped member 316 of the first part 312. The perimeter circumferential edge of the respective disc-shaped member 332 of the second part 314 is proximate to the third disc-shaped member 318 of the first part 312 when the two parts 312, 314 rotate relative to one another.

Figure 8:
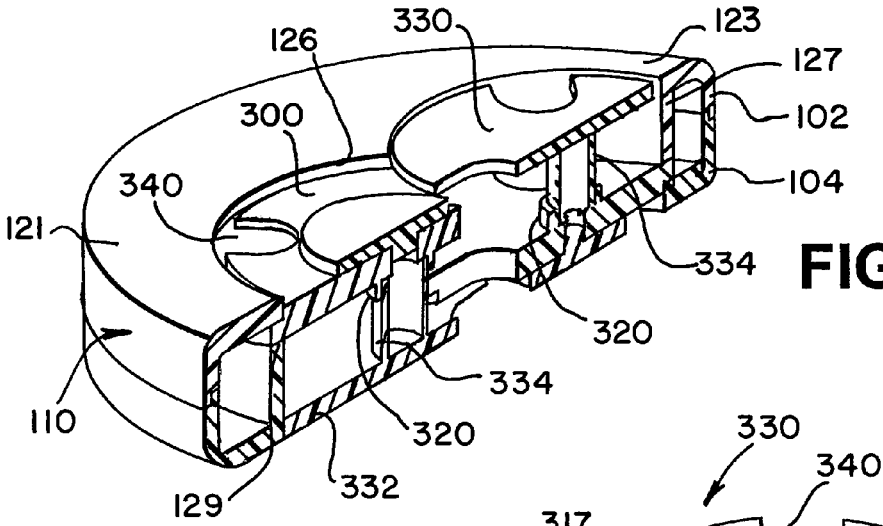
FIG. 8 is a perspective view, in partial cross-section, of a section of a head portion of the hair braider of FIG. 1.

As shown in FIG. 8, when the two parts (first and second molded parts 102, 104) of the head 110 are assembled together, and in one exemplary embodiment, the first part 102 of the head 110 that defines the upper face 113, as well as the second part 104 thereof that defines the lower face 115, has two distinct sections, namely a first section 121 that cooperates with and complements the first gear wheel 300 and a second section 123 that cooperates with and complements the second gear wheel 330. The first section 121 is generally an L-shaped body that has a portion of the cut out 126 formed therein and the second section 123 is generally a U-shaped body that includes the other portion of the cut out 126. The second section 123 includes an inner vertical wall 127. It will be appreciated and as shown in the cross-sectional view of FIG. 8, the first section 121 of the first head part 102 mates with the second section 123 of the second head part 104 and the second section 123 of the first head part 102 mates with the first section 121 of the second head part 104. There is a space 129 that is formed between the vertical wall 127 of the second section 123 and the opposing, facing horizontal wall of the first section 121.

Figure 1:
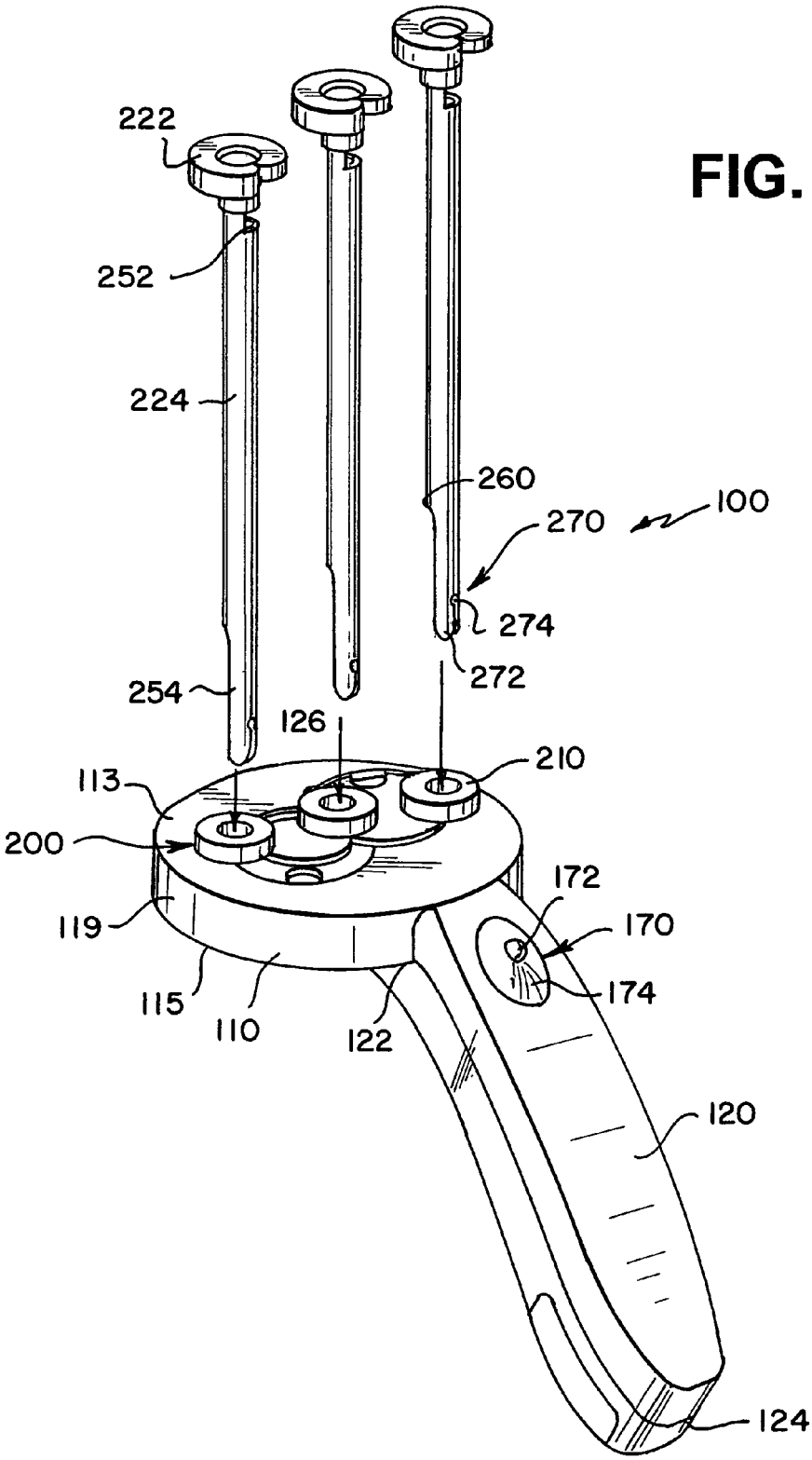
FIG. 1 is a top and side perspective view of a hair braider according to one exemplary embodiment with hair threaders being exploded therefrom.

In this arrangement, the first gear wheel 300 is disposed in the head 110 such that the first disc-shaped member 316 of the first part 312 is received in the space 129 such that an inner edge of the first section 121 that defines the section of the cut out 126 is received in and faces the shoulder formed between the first and second disc-shaped members 316, 317. The disc-shaped member 332 of the second part 314 is disposed adjacent the vertical wall 127. The second gear wheel 330 has the same arrangement except that the second gear wheel 330 has an opposite orientation since the second section 123 adjacent the second gear wheel 330 is formed as part of the first head part 102 and the first section 121 is formed on a bottom section of the second head part 104. FIG. 1 shows one cylindrical post 210 in the center location.

When assembling the braider 100, the cylindrical posts 210 are first disposed within respective notches 340 of one of the parts 312, 314 of the gear wheel and then the other part 312, 314 is mated thereto so as to lock the cylindrical posts 210 in the respective notches 340 with the flanges 214 being disposed adjacent to an outer face of each of the parts 312, 314. The assembled gear wheels 300, 330 can then be disposed within the head 110 which at this point in time is separated into the first and second head parts 102, 104 to permit reception of the gear wheels and other working components therebetween before final assembly of the head 110 and the braider 100 is performed and completed.

It will further be appreciated that the first and second gear wheels 300, 330 are driven members in that the drive gear of braider 100 and more specifically, the rotation thereof causes the first and second gear wheels 300, 330 to themselves rotate in opposing directions. In one exemplary embodiment, each of the first and second gear wheels 300, 330 includes a plurality of teeth formed along a perimeter outer edge thereof for meshing with complementary teeth formed as part of the drive gear 154 or other intermediate gears that are operatively coupled to drive gear. Both of the first and second gear wheels 300, 330 are rotatably disposed within the head 110 of the hair braider 100 and are operatively connected to the drive source.

The shape of the notches 340 is also variable and more specifically, the edges of the notches 340 can be rounded or beveled as opposed to being more of a sharp outer edge. For example, as shown in FIG. 15, one of the edges of the notch at the circumferential outer edge of the gear wheel is cut away so as to form a beveled edge which permits the cylindrical post that carries the thread of hair to be more freely and smoothly transferred from one gear wheel to the other gear wheel as described herein.

The hair braider 100 also includes a number of other gear members (e.g., driven gears and idler gears) that are rotatably disposed within the head 110 of the braider 100 and are arranged to cooperate with the drive gear 154, one of the gear wheels 300, 330, and/or another one of the gears. More specifically, these toothed gears are arranged to move the gear wheels 300, 330 in opposing directions. Thus, for example, the first gear wheel 300 (left gear wheel) turns counterclockwise, while the second gear wheel 330 (right gear wheel) turns clockwise; however, the direction of rotation of these two members can equally be reversed. For example, the gears are typically arranged radially around the first and second gear wheels 300, 330 and represent driven gears and idler gears. Each of the gears has a disc-shaped (circular) body and is rotatably supported in the head 110 by a support post or the like. The size of the gears is variable and not all of the gears in the head 110 are of the same size. In other words, the gears 300, 330 are annular gears of different sizes.

In one exemplary embodiment, there are at least ten other gears that are arranged about the first and second gear wheels 300, 330 within the head 110. These gears exclude the drive gear 154 and gears that are associated with a post changing mechanism 400. For example, gears 600, 602, 603, 604, 605 and 606 are arranged on one side of first and second gear wheels 300, 330 and gears 607, 608, 609 and 610 are arranged on the other side of the gear wheels 300, 330. In one exemplary embodiment, all of the gears are about the same size (diameter) except gears 602 and 605 which are larger than the other gears.

The gears 607, 608 are arranged adjacent to and in communication with the left gear wheel 300, while the gears 609 and 610 are arranged adjacent to and in communication with the right gear wheel 330. The gears associated with the post changing mechanism 400 are disposed between these gears. The gears 607 and 608 are also in communication with each other (rotate together) and similarly, the gears 609 and 610 are in communication with each other.

In one exemplary embodiment, the drive gear 154 is coupled to the third gear 603 and therefore, rotation of the drive gear 154 is translated into rotation of the third gear 603 which itself is coupled to the first gear wheel 300 and therefore, rotation is imparted to the first gear wheel 300 in a first direction. Since the third gear 603 is coupled to the fourth gear 604, the rotation of the gear 603 in one direction is translated into rotation of the gear 604 in an opposite direction. Since the gear 604 is coupled to the second gear wheel 330, rotation is translated to the second gear wheel 330 in a direction opposite the direction of the first gear wheel 300. For example, if the drive gear 154 rotates in a counterclockwise direction, the first gear wheel 300 rotates in a counterclockwise direction, while the second gear wheel 330 rotates in a clockwise direction since the gear 603 rotates in a clockwise direction, the gear 604 rotates in a counterclockwise direction, the gear 602 rotates in a counterclockwise direction, the gear 600 rotates in a clockwise direction, the gear 605 rotates in a clockwise direction, the gear 606 rotates in a counterclockwise direction, the gear 607 rotates in a clockwise direction, the gear 608 rotates in a counterclockwise direction, the gear 609 rotates in a clockwise direction, and the gear 610 rotates in a counterclockwise direction.

The gears that are associated with the post changing mechanism 400 include four gears and more specifically, include a pair of outer gears 410 and a pair of inner gears 420 that are disposed between the pair of outer gears 410. Each inner gear 420 partially overlaps the adjacent outer gear 410. Each outer gear 410 includes a first toothed gear body 412 and a second toothed body 414 that is integrally disposed or formed on an upper face of the first toothed gear body 412. As shown, the second toothed body 414 has a diameter that is less than the diameter of the first toothed body 412 and preferably, the second toothed body 414 is centrally located on the first toothed body 412. A post or pin 416 extends upwardly from the second toothed body 414 (preferably from the center thereof).

Each inner gear 420 is formed of a toothed circular body that is disposed in at least a partially overlapping manner with respect to the adjacent outer gear 410 such that the teeth of the inner gear 420 intermesh with the teeth of the second toothed body 414 of the outer gear 410. Thus, rotation of the outer gear 410 in one direction is translated into rotation of the intermeshed inner gear 420 in the opposite direction. The inner gear 420 also has a post or pin 422 that extends upwardly from the center thereof and further includes a stop 424 that is formed at an outer edge thereof and extends upwardly in the same direction as the post 422. The two inner gears 420 face one another; however, they do not cooperate with one another. In other words, the teeth of the two inner gears 420 do not intermesh with one another.

In the illustrated embodiment, the teeth of the outer gear 410 intermesh with one of the gear wheels 300, 330; however, the adjacent inner gear 420 is not coupled (intermeshed) with the gear wheel or any other gear and therefore, the rotation of the outer gear 410 due to rotation of the respective gear wheel 300, 330 causes the rotation of the inner gear 420 due to the coupling between the two. This in turn causes the upstanding stop 424 to rotate. In the illustrated embodiment, the outer gear 410 associated with the first gear wheel 300 rotates in a clockwise direction while the respective intermeshed inner gear 420 rotates counterclockwise and the outer gear 410 associated with the second gear wheel 330 rotates in a counterclockwise direction while the respective intermeshed inner gear 420 rotates clockwise. It will be appreciated that all of the above rotational directions for the gears can be reversed since they are dictated by the initial rotational direction of the drive gear 154 and therefore, rotation of the drive gear 154 in an opposite direction will cause all of the gears to rotate in directions opposite to those stated above.

The drive gear 154 is disposed within the head 110 of the hair braider 100 such that the drive gear 154 is operatively coupled to the drive source, i.e., the motor 140, such that activation of the drive source causes the drive gear to rotate. More specifically, the drive gear 154 includes a disc-shaped body 155 that has teeth formed along its outer circumferential edge and a shaft or some other type of protruding member is provided to cooperate with and be operatively coupled to a drive shaft of the motor 140 such that upon activation of the motor 140, the drive shaft is rotated and this rotation is translated to rotation of the drive gear. In a simple arrangement, the drive gear 154 is merely formed at the end of the drive shaft and toothed body 155 meshes with a lower section of the adjacent driven gear 603. The drive gear 154 is formed proximate one or both of gear wheels 300, 330. This allows the rotation of the drive gear to be directly translated into rotation of both of the gear wheels.

It will be understood that the number of gears and the arrangement thereof can be easily varied so long as the gears translate rotation of the drive gear 154 to opposite rotation of the gear wheels 300, 330 and they ensure that the gear wheels 300, 330 smoothly rotate within the head 110. Thus, the number of gears that is shown is only exemplary and more or less gears can be used for translating rotation to the gear wheels 300, 330.

Post changing mechanism 400 is provided for transferring one cylindrical post from one notch 340 in one of the gear wheels 300, 330 to one notch 340 in the other of the gear wheels 300, 330. The mechanism is automatically actuatable in that the rotation of the inner gears 420 causes the operation of the mechanism 400. In addition to the above described gears, the mechanism 400 includes an urging element (pivotable lever) 430 that urges one cylindrical post from one gear wheel to the other gear wheel. The urging element 430 is supported on a post or like 432 which defines the pivot point of the body thereof. The urging element 430 acts as a wiper device in that it contacts and sweeps the cylindrical post 210 out of one notch in one gear wheel and into and aligned notch formed in the other gear wheel when the two notches 340 are aligned with one another in the center of the head 110. When the two notches 340 align with one another, a completely bounded opening is formed with its ends defined by the inner edges of the notches 340. The notches 340 are formed in the first and second gear wheels 300, 330 and the gear wheels rotate such that two pairs of notches 340 formed on the opposite gear wheels come together and are aligned with each other in the center location of the head 110.

The urging element 430 is configured and disposed within the head 110 such that when the urging element 430 pivots to urge and transfer the cylindrical post 210 from one notch 340 in one gear wheel 300, 330 to another notch 340 in the other gear wheel 300, 330, the urging element 430 is disposed between the two parts 312, 314. Thus, the spacing of the two parts 312, 314 is to permit the urging element 430 to be received therebetween so as to contact and urge the cylindrical post 210. Since the spacings of the first and second gear wheels 300, 330 are aligned, the urging element 430 can freely rest between the parts 312, 314 of one of the gear wheels 312, 314 and then freely move between the parts 312, 314 of the other gear wheel 312, 314.

The body of the urging element 430 can assume any number of different shapes and sizes; however, the body includes an elongated arm 440 that extends outwardly from a pivotable base of the urging element 430 and is configured to sweep the cylindrical post 210 from one gear wheel to the other gear wheel. The urging element 430 can be generally T-shaped or it can have a smoother shape with the arm 440 being defined by arcuate faces (e.g., concave surfaces) that lead to a distal end 442 as illustrated in FIGS. 1A and 1B. The distal end 442 is long enough such that it extends beyond the notches 340 when the notches 340 are aligned with one another at the center location so as to permit contact between the urging element 430 and the cylindrical post 210.

The urging element 430 is pivotable mounted within the head 110 such that the body thereof partially overlaps the inner gears 420 at select times as the urging element 430 rotates about the pivot. The urging element 430 is thus constructed so that the body thereof can be disposed over the inner gears 420. The urging element 430 is also mounted so that the body thereof cooperates with and is urged by the stops 424 formed as part of the inner gears 420. More specifically, the stops 424 are arranged on the inner gears 420 and these inner gears 420 rotate such that stops 424 contact the urging element body and prevent movement of the urging element 430 or urge the urging element body in a selected direction.

Figure 10A:
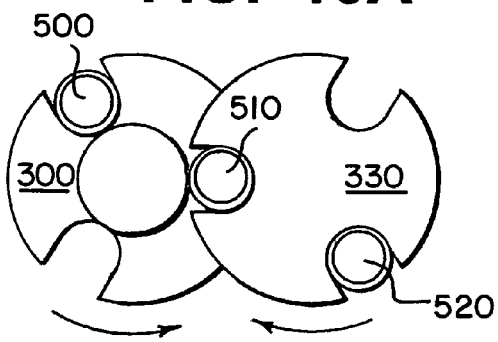
Figure 10E:
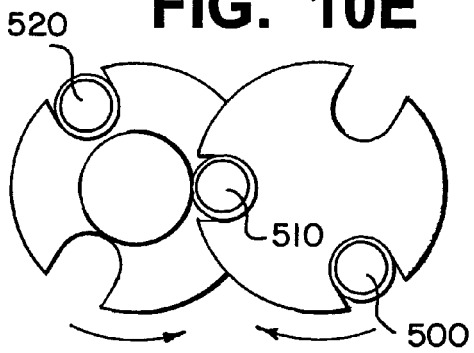
Figure 10B:
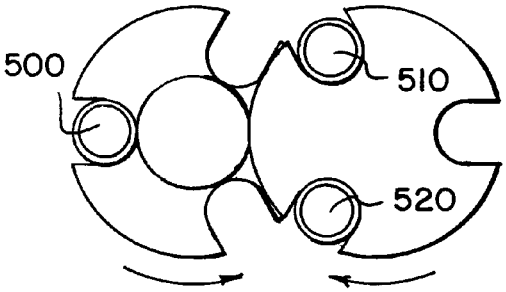

FIGS. 10A and 10B illustrate movement of the cylindrical posts 210 as the first and second gear wheels 300, 330 are journaled by the motor 140. Rotation of the first and second gear wheels 300, 330 causes the cylindrical posts 210 to move in clockwise and counterclockwise directions, and further to be transferred from one rotor to another with the assistance of the urging element 430. The cylindrical posts 210 migrate from a rest condition as shown in FIG. 10A to a final position in FIG. 10B where the cylindrical posts 210 have swapped positions with one another. The urging element 430 is advanced from its left position to its right position so as to urge the cylindrical posts 210 from one gear wheel 300, 330 to the other in response to the gearing associated with the gear wheels 300, 330.

Figure 10F:
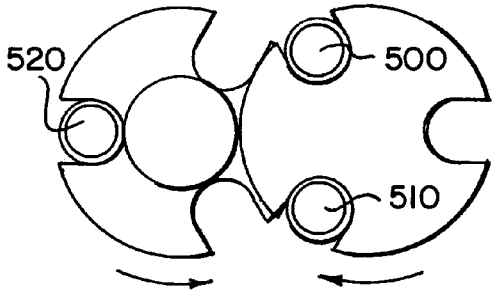
Figure 10C:
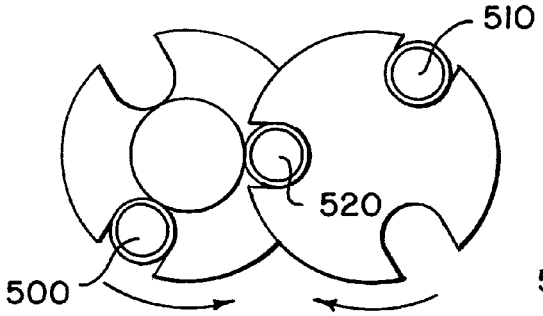

In operation, bundles of hair 500, 510, 520 are received in respective cylindrical posts 210. Initially, the bundles of hair have a first orientation relative to one another, such as shown in FIG. 10A in which their left-to-right order is 500, 510, 520, extending along a diagonal line across the top of the head 110. Upon rotation of the drive shaft, the gear wheels 300, 330 are journaled in opposite directions such that the cylinders are carried in respective circular orbits until, as shown in FIG. 10C, the left-to-right order of the hair bundles becomes 500, 510, 520. This is the beginning of a true, three bundle plait or braid. With continued rotation of the rotors, urging element 430, as described in greater detail herein, moves the cylindrical post loaded with hair bundle 520 over to the first gear wheel 300 such that further rotation of the gear wheels 300, 330 causes the left-to-right order of the bundles to become 520-500-510. Again, with further rotation, the urging element 430 operates to transfer a cylindrical post 210 from one gear wheel to the other.

Figure 10G:
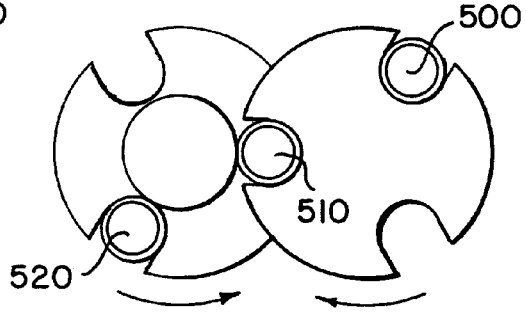
Figure 10D:
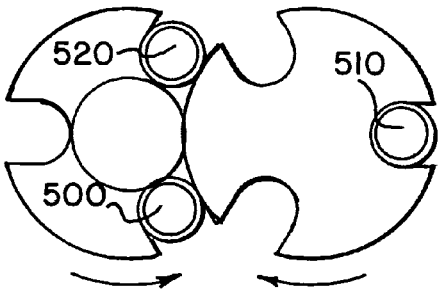
Figure 10H:
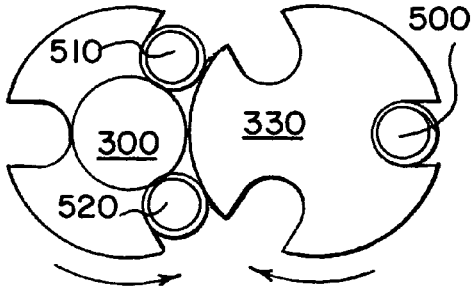

In FIG. 10D, the urging element 430 moved leftward to urge the cylindrical post with bundle 520 to the gear wheel 300. In FIG. 10F, the urging element 430 returns to its rightward position when it urges the cylindrical post containing bundle 500 to the second gear wheel 330. Further rotation of the first and second gears wheels 300, 330 result in a left-to-right order of the bundles to become 520, 510, 500, as shown in FIG. 10G. FIG. 10G has reverse order as compared to FIG. 10A. This process continues such that the central and right bundles swap positions and then the central and left bundles swap positions, as shown in the chart below. The result on the hair of the person or doll is a true, three-bundle plait or braid.

| | | | |
|---|---|---|---|
| As illustrated: | 500 | 510 | 520 |
| | 500 | 520 | 510 |
| | 520 | 500 | 510 |
| | 520 | 510 | 500 |
| | 510 | 520 | 500 |
| And continuing | ⋮ | ⋮ | ⋮ |

The process or operation continues until the three bundles of hair of the user have been sufficiently plaited so as to form a classic, true three bundle braid. It will therefore be appreciated that the number of transfers of the cylindrical posts 210 from one rotor 300, 330 to the other rotor 300, 330 depends upon the length of the bundles of hair since the longer the hair bundles, the more plaiting or braiding is needed. This translates into an increase in the number of transfers of the cylindrical posts 210.

It will therefore be appreciated that the present hair braider 100 overcomes those deficiencies associated with prior art devices and provides a true, classic three bundle hair plait of braid as opposed to a two bundle hair plait or braid. The present braider 100 is easy to operate and is of a robust construction.

While this invention has been particularly shown and described with references to preferred embodiments thereof, it will be understood by those skilled in the art that various changes in form and details may be made therein without departing from the scope of the invention encompassed by the appended claims.

What is claimed is:

1. A hair braider configured to perform a three-bundle plait or braid comprising:

a body having a handle and a head portion at one end of the handle;

a selectively actuatable drive source disposed within the body;

first and second rotatable rotors that are disposed within the head portion and are accessible through openings formed in the head portion, the first and second rotatable rotors being operatively coupled to the drive source through a plurality of gears such that the first and second rotors simultaneously rotate in opposite directions when the drive source is actuated, wherein the first and second rotatable rotors are at least partially overlapped;

a plurality of hair retaining members that are received within openings formed through the first and second rotatable rotors, each hair retaining member having a bore formed therethrough for receiving one bundle of hair; and a mechanism for continuously transferring at a transfer location one hair retaining member from one rotor to the other rotor as the rotors rotate simultaneously, wherein the initial arrangement of the hair retaining members within the openings, the simultaneous rotation of the rotors in opposite directions and the successive transfer of one hair retaining member from one rotor to the other rotor results in a true, three-bundle braid being formed, wherein the mechanism includes a pivotable urging element that is separate from the rotors and selectively contacts and urges the hair retaining member and transfers it from one rotor to the other rotor and a plurality of gears that cooperate with one of the first and second rotors or the urging element such that the urgent element is actively driven by rotation of the gears.

2. The hair braider of claim 1, wherein the openings formed in the head portion comprise a first opening formed in an upper face thereof and a second opening formed in an opposing lower face thereof, the first and second openings being aligned with one another so as to permit the bundles of hair to be received in and extend completely through the head portion while also permitting the bundles of hair to be rotated within the head portion and transferred from the one rotor to the other rotor.

3. The hair braider of claim 2, wherein each of the first and second openings has a first substantially circular section that is adjacent the first rotor and a second substantially circular section that is adjacent the second rotor.

4. The hair braider of claim 1, wherein the head portion is formed of an upper body section and a lower body section that are coupled to one another and secured to one another by fasteners or by a snap-fit arrangement.

5. The hair braider of claim 1, wherein the drive source comprises a motor that is coupled to a gear box that includes a drive shaft and a main drive gear formed at the end of the drive shaft, wherein rotation of the drive gear in one direction is transferred through the plurality of gears into rotation of the rotors in opposite directions.

6. The hair braider of claim 5, wherein the drive gear is disposed at an angle relative to the other gears that are operatively coupled to the first and second rotors.

7. The hair braider of claim 5, wherein teeth of the drive gear intermesh with complementary teeth of a first idler gear which also intermeshes with teeth of the first rotor to cause rotation in a first direction, the teeth of the first idler gear also intermeshing with teeth of a second idler gear which also intermeshes with teeth of the second rotor to cause rotation in a second direction.

8. The hair braider of claim 1, wherein each hair retaining member is formed of a cylindrical post that has the bore formed therethrough for receiving one bundle of hair and a hair threader that is removably received through the bore after the bundle of hair is arranged relative to and carried by the threader.

9. The hair braider of claim 8, wherein the cylindrical post has a cylindrical body that includes the bore and a pair of flanges formed at and extending outwardly from ends of the cylindrical body.

10. The hair braider of claim 9, wherein a lowermost flange includes a lip that is formed around a perimeter edge of the flange.

11. The hair braider of claim 10, further including an elastic ring-shaped member that is received and retained within the lip against an underside of the lowermost flange.

12. The hair braider of claim 11, wherein the ring-shaped member is formed of an elastic, flexible rubber material.

13. The hair braider of claim 8, wherein the hair threader is formed of a threader head and an elongated tube member that is securely coupled to and extends outwardly from the threader head, the tube member having a diameter that is less than a diameter of the bore formed in the cylindrical post to permit the tube member to be received through the cylindrical post.

14. The hair braider of claim 13, wherein the threader head has a bore extending therethrough for receiving one bundle of hair with a channel being formed in the head from an outer edge to the bore so that the bundle of hair can be introduced to the bore through the channel.

15. The hair braider of claim 13, wherein the elongated tube member includes a first cut out formed at a first end of the tube member and a second cut formed at a second end which is formed of a split finger construction.

16. The hair braider of claim 15, wherein a channel is formed between the split fingers, one end of the channel forming an entrance to an opening that is configured to receive the bundle of hair.

17. The hair braider of claim 13, wherein the elongated tube member includes a flat formed therealong from one end of the first end to the second end thereof.

18. The hair braider of claim 16, wherein during operation thereof, one bundle of hair is fed first through the channel in the threader head into the bore of the threader head and then out through the first cut-out and along an outer surface of the elongated tube member to the split finger construction where the hair is fed between the split finger into the second cut out and then up along the outer surface of the elongated tube member.

19. The hair braider of claim 1, wherein each of the first and second rotors is formed of two parts that releasably engage one another, a first part being formed of three concentric discs stacked on top of one another and a second part being formed of a disc, the first and second parts being spaced apart from one another by a spacer, the first and second parts having notches formed therein that are aligned with one another to form the openings formed in the respective rotor.

20. The hair braider of claim 19, wherein the first and second rotors at least partially intermesh with one another with two of the concentric discs of the first part of one rotor being disposed between the first and second parts of the other rotor.

21. The hair braider of claim 19, wherein the first and second rotors at least partially intermesh with one another and one concentric disc of the first part that is free of notches of one rotor lies in the same plane as the disc of the second part of the adjacent other rotor.

22. The hair braider of claim 19, wherein the spacer is formed by a first boss formed as part of the first part and a second boss that is formed as part of the second part, the first and second bosses mating together to securely attach the first and second parts to one another.

23. The hair braider of claim 19, wherein an uppermost concentric disc is free of notches and is in the form of a solid disc.

24. The hair braider of claim 1, wherein the first and second rotors are orientated in an opposite manner in the head.

25. The hair braider of claim 19, wherein the first part of the first rotor faces upright, while the second part of the second rotor faces upright.

26. The hair braider of claim 1, wherein the first rotor includes three openings in the form of notches formed in an outer edge thereof and the second rotor includes three openings in the form of notches formed in an outer edge thereof.

27. The hair braider of claim 26, wherein the first and second rotors at least partially overlap with one another so that during operation one notch of one rotor comes into registration with one notch of the other rotor in a center transfer position.

28. The hair braider of claim 1, wherein the plurality of gears associated with the transfer mechanism include a pair of outer gears and a pair of inner gears, one outer gear being intermeshed with the first rotor and the other outer gear being intermeshed with the second rotor, the inner gears being intermeshed with the outer gears.

29. The hair braider of claim 28, wherein each of the outer gears includes a first toothed gear body that intermeshes with teeth of the first rotor and a second toothed gear body formed on the top face of the first toothed gear body, the second toothed gear body being intermeshed with teeth of the adjacent inner gear.

30. The hair braider of claim 28, wherein each inner gear includes an upstanding stop that is formed on an outer edge of the inner gear that selectively contacts the urging element to cause movement thereof as the inner gears rotate in turn with rotation of the first and second rotors.

31. The hair braider of claim 28, wherein the urging element is disposed above bodies of the inner gear so that it at least partially overlaps the bodies but is disposed so that it can be contacted by the stops such that rotation of the stops causes the urging element to be urged between a first position from which the urging element urges the hair retaining member from the first rotor to the right rotor and a second position from which the urging element urges the hair retaining member from the second rotor to the first rotor.

32. The hair braider of claim 1, wherein the urging element includes an elongated arm that is adapted to contact a hair retaining member that is disposed in one rotor notch that is located in a center position within the head, wherein in this center position, a complementary notch formed in the other rotor is aligned with the one rotor notch to form an enclosed opening to permit transfer of the hair retaining member from one rotor to the other.

33. The hair braider of claim 1, wherein the plurality of gears include a plurality of idler gears that are arranged about and intermesh with teeth of one of the first and second rotors.

34. The hair braider of claim 33, wherein the plurality of idler gears includes at least ten idler gears with teeth of the five idler gears being intermeshed with the first rotor and teeth of the other five idler gears being intermeshed with the second rotor.

35. The hair braider of claim 34, wherein one of the idler gears is a first driven wheel that has teeth intermeshed with teeth of the drive gear and a second driven wheel that has teeth that intermeshes with the first driven wheel and with teeth of the second rotor, wherein the drive gear and the second driven wheel are rotated in a first direction, while the first driven wheel rotates in an opposite second direction, thereby resulting in the first rotor rotating in the first direction and the second rotor rotating in the second direction.

36. The hair braider of claim 1, wherein in an initial position, the left-to-right order of a first hair bundle (A), a second hair bundle (B) and a third bundle of hair (C) is A, B, C with bundles A and B being joumaled within the first rotor and as the rotors rotate in opposite direction, the hair retaining members are carried in respective circular orbits until the left- to-right order of the hair bundles becomes A, C, B with bundles B and C being joumaled within the second rotor and the mechanism urges the bundle C to the first rotor and further rotation of the first and second rotors causes the left-to-right order of the hair bundles to become C, A, B with hair bundles C and A being joumaled within the first rotor and whereupon further rotation of the rotors causes the mechanism to transfer the bundle A to the second rotor and further rotation of the rotors results in the left-to-right order of C, B, A which is a reverse order as compared to the initial position and further operation of the hair braider results in central and right hair bundles swapping positions and then the central and left hair bundles swapping positions.

37. A hair braider configured to perform a three-bundle plait or braid comprising:

a body having a handle and a head portion at one end of the handle;

a selectively actuatable drive source disposed within the body;

first and second rotatable rotors that are disposed within the head portion and are accessible through openings formed in the head portion, the first and second rotatable rotors being operatively coupled to the drive source through a plurality of gears such that the first and second rotors rotate in opposite directions when the drive source is actuated, wherein the first and second rotatable rotors are at least partially overlapped and rotate simultaneously;

a plurality of hair retaining members that are received within openings formed in the first and second rotors and act to carry one bundle of hair, the first and second rotors at least partially overlap such that in a transfer location, one opening of one rotor overlaps one opening in the other rotor, a mechanism for automatically continuously transferring one hair retaining members from one rotor to the other rotor whenever the one hair retaining member is disposed in the transfer location as the rotors rotate simultaneously; and wherein a first bundle of hair is disposed in a hair retaining member and through one opening in the first rotor; a second bundle of hair is disposed in another hair retaining member and through another opening in the first rotor and a third bundle of hair is disposed in another hair retaining member and through one opening in the second rotor such that in a left-to-right order of the hair bundles there is a left hair bundle, a central hair bundle and a right hair bundle, wherein in the initial position, the first hair bundle is the left hair bundle, the second hair bundle is the central hair bundle and the third hair bundle is the right hair bundle, wherein the central hair bundle is always disposed in the transfer location; and simultaneous rotation of the first and second rotors in opposite directions causes the three hair bundles to be carried in respective circular orbits and results in a number of successive hair bundle swaps being preformed as a result of the rotation of the rotors and action of the mechanism with the swaps being defined by successive swaps of the central hair bundle and one of the left and right hair bundles and then the central hair bundle with the other of the left and right hair bundles, thereby resulting in a three-bundle braid being formed.

38. A method of braiding hair in a three-bundle plait or braid comprising the steps of:

providing a hair braider according to claim 1;

disposing a first bundle of hair (A) in a hair retaining member and through one opening in the first rotor; a second bundle of hair (B) in another hair retaining member and through another opening in the first rotor and a third bundle of hair (C) in another hair retaining member and through one opening in the second rotor such that the left-to-right order of the hair bundles is A, B, C, with the hair bundle A being defined as a left hair bundle, the hair bundle B being defined as a central hair bundle and the hair bundle C being defined as a right hair bundle;

simultaneously rotating the first and second rotors in opposite directions with the hair bundles A, B, C being carried in respective circular orbits until the left-to-right order of the hair bundles becomes A, C, B as a result of the mechanism transferring the hair retaining member carrying the hair bundle B to the second rotor; wherein further simultaneous rotation of the rotors causes the left-to-right order of the hair bundles to be C, A, B as a result of the mechanism transferring the hair retaining member carrying the hair bundle C to the first rotor and further rotation of the rotors and the mechanism acting to transfer the hair retaining member carrying the hair bundle A to the second rotor results in the left-to-right order of the hair bundles to be C, B, A which is a reverse order compared to an initial position; and further simultaneously rotating the first and second rotors and activating the mechanism results in the hair bundles swapping position to form a three-bundle braid.

39. A method of braiding hair in a three-bundle plait or braid comprising the steps of:

providing a hair braider that includes:

first and second rotors that simultaneously rotate in opposite directions under the action of a drive mechanism and which are at least partially overlapped;

a plurality of hair retaining members that are received within openings formed in the first and second rotors and act to carry one bundle of hair, the first and second rotors at least partially overlap such that in a transfer location, one opening of one rotor overlaps one opening in the other rotor, and a mechanism for automatically and continuously transferring one hair retaining members from one rotor to the other rotor whenever the one hair retaining member is disposed in the transfer location, disposing a first bundle of hair in a hair retaining member and through one opening in the first rotor; a second bundle of hair in another hair retaining member and through another opening in the first rotor and a third bundle of hair in another hair retaining member and through one opening in the second rotor such that in a left-to-right order of the hair bundles there is a left hair bundle, a central hair bundle and a right hair bundle, wherein in the initial position, the first hair bundle is the left hair bundle, the second hair bundle is the central hair bundle and the third hair bundle is the right hair bundle, wherein the central hair bundle is always disposed in the transfer location; and simultaneously rotating the first and second rotors in opposite directions with the three hair bundles being carried in respective circular orbits such that a number of successive hair bundle swaps are preformed as a result of the rotation of the rotors and action of the mechanism with the swaps being defined by successive swaps of the central hair bundle and one of the left and right hair bundles and then the central hair bundle with the other of the left and right hair bundles, thereby resulting in a three-bundle braid being formed.

* * * * *